US005269381A

United States Patent [19]

Oscarsson

[11] Patent Number: 5,269,381

[45] Date of Patent: Dec. 14, 1993

[54] VIBRATION DAMPED HAND HELD RIVET BUCKING TOOL

[75] Inventor: Jan-Erik Oscarsson, Saltsjö-Boo, Sweden

[73] Assignee: Atlas Copco Tools AB, Stockholm, Sweden

[21] Appl. No.: 971,077

[22] Filed: Nov. 3, 1992

[30] Foreign Application Priority Data

Nov. 4, 1991 [SE] Sweden ..... 9103226

[51] Int. Cl.[5] ..... B25D 17/24

[52] U.S. Cl. ..... 173/162.2; 72/465

[58] Field of Search ..... 173/162.1, 162.2; 72/465

[56] References Cited

U.S. PATENT DOCUMENTS

| | | | |
|---|---|---|---|
| 2,290,256 | 7/1942 | Souter | 173/162.2 |
| 2,349,341 | 11/1942 | Disse . | |
| 2,899,934 | 8/1959 | Salengro . | |
| 4,723,610 | 2/1988 | Dummermuth . | |

FOREIGN PATENT DOCUMENTS

| | | | |
|---|---|---|---|
| 1231192 | 9/1960 | France . | |
| 366239 | 4/1974 | Sweden . | |
| 768976 | 10/1980 | U.S.S.R. | 173/162.2 |

OTHER PUBLICATIONS

Derwent Abstract No. 87-184120/26 of Swedish SU 800065, Oct. 9, 1984.

*Primary Examiner*—Scott Smith

*Attorney, Agent, or Firm*—Frishauf, Holtz, Goodman & Woodward

[57] ABSTRACT

A vibration damped hand held rivet bucking tool having a vibration exposed inertia member (10) provided at a forward end with a rivet engaging implement and a handle (12) insulated from the inertia member (10) by means of two pretensioned coil-type springs (15, 16) which have different diameters and which are located with the small diameter spring (16) inside the large diameter spring (15). A sleeve element (17) connected to the inertia member (10) is located between the springs (15, 16), and a central rod (18) connected to the handle (12) extends into the small diameter spring (16). The large diameter spring (15) acts between a shoulder (23) on the sleeve element (17) and the handle (12), respectively, whereas the small diameter spring (16) acts between an inner shoulder (24) on the sleeve element (17) and an outer shoulder (26) on the central rod (18). A central bore (20) in the inertia member (10) accommodates the springs (15, 16) and the sleeve element (17).

7 Claims, 1 Drawing Sheet

VIBRATION DAMPED HAND HELD RIVET BUCKING TOOL

BACKGROUND OF THE INVENTION

This invention relates to a vibration damped hand held rivet bucking tool having a vibration exposed part and a handle means, and comprising a pretensioned spring means interposed between the handle means and the vibration exposed part.

One problem with previously known vibration damped rivet bucking tools is the difficulty to accomplish very compact tools suitable for operation in narrow working areas.

Other problems inherent in prior art rivet bucking tools of the above type are both structural complexity and poor operational features.

An example of a hand held tool having a spring type impact damping system is illustrated in U.S. Pat. No. 2,899,934, FIG. 1*a*. The springs of this device act between ring elements which are axially displaceable at compression or expansion of the springs. Such a spring support arrangement not only gives rise to undesirable friction forces but causes, due to axial play or "free space" relative to abutting shoulders, a clapping non-continuous action of the damping system.

SUMMARY OF THE INVENTION

The above problems are solved by the rivet bucking tool according to the invention which comprises a vibration damping system having simple structural features, a continuous damping action and a compact design.

A preferred embodiment of the invention is hereinbelow described in detail with reference to the accompanying drawing.

DETAILED DESCRIPTION

Figure 1:
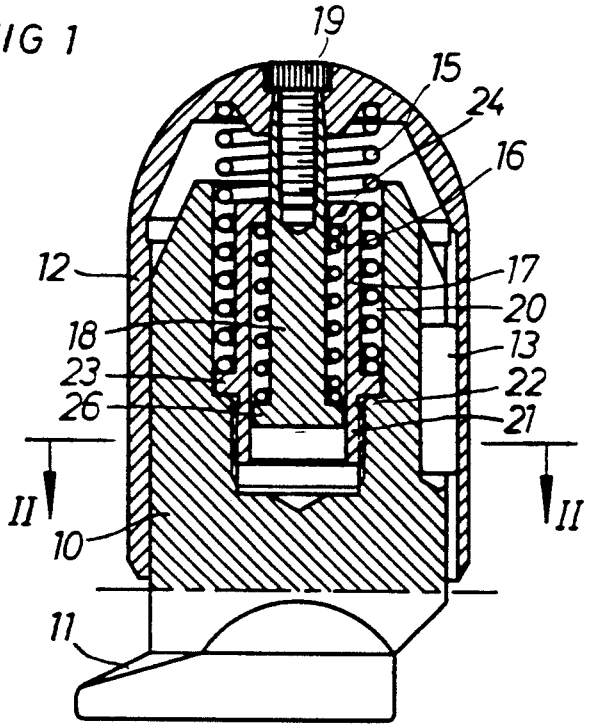
FIG. 1 shows a longitudinal section through a vibration damped tool according to the invention.

The tool illustrated on the drawing is a rivet bucking tool intended to be used together with an impact type rivet hammer. Accordingly, the illustrated tool is a passive tool without any vibration generating power means, but is intended to receive repeated impact energy via the rivets being set.

Figure 2:
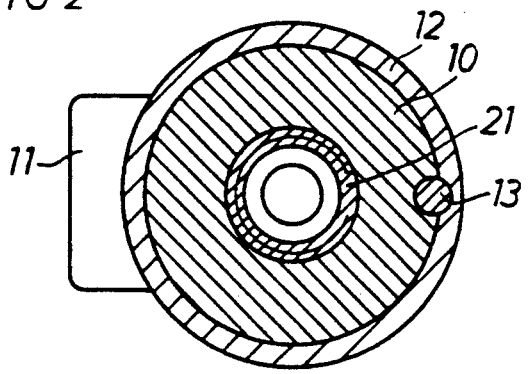
FIG. 2 shows a cross section along line II—II in FIG. 1.

For absorbing and reflecting the impact energy back to the rivet being worked, the tool comprises a vibration exposed part in the form of an inertia member 10 of a relatively large mass. At its forward end, the inertia member is provided with a rivet engaging implement 11. A handle in the form of a cup-shaped grip element 12 is guidingly supported relative to the inertia member 10 and encloses a major part of the latter. The grip element 12 and the inertia member 10 have circular cross sections and are rotationally interlocked by a key 13. See FIG. 2.

Accordingly, the grip element 12 is telescopically guided relative to the inertia member 10 so as to allow axial reciprocal movement of the inertia member 10 in relation to the grip element 12 during operation of the tool. Between the grip element 12 and the inertia member 10, however, there is provided a vibration damping spring system. This spring system comprises two pretensioned compression springs 15, 16 of the cylindrical coil type, a support sleeve 17, and a central rod 18. The central rod 18 is secured to the grip element 12 by means of a screw 19. The two springs 15, 16 comprise one large diameter spring 15 and one small diameter spring 16 and are disposed coaxially with each other with the small diameter spring 16 located inside the large diameter spring 15.

The support sleeve 17 is located in a coaxial bore 20 in the inertia member 10 and is secured to the inertia member 10 by a threaded socket 21. A shoulder 22 in the bore 20 is engaged by an outer flange 23 on the sleeve 17 and defines the axial position of the sleeve 17 relative to the inertia member 10. The flange 23 also forms an axial support for the large diameter spring 15. Alternatively, the sleeve 17 could be formed without the flange 23 and instead have its axial position defined by its end engaging the bottom of the bore 20. Then, spring 15 would take support directly against the shoulder 22 on the inertia member 10.

The sleeve 17 also comprises an inner shoulder 24 to form a support for the small diameter spring 16, and the central rod 18 has an annular shoulder 26 at its forward end to form an oppositely facing support for the small diameter spring 16.

The large diameter spring 15 acts between the sleeve flange 23, which is rigidly associated with the inertia member 10, and the grip element 12, thereby urging the grip element 12 backwards relative to the inertia member 10.

The small diameter spring 16 acts between the inner shoulder 24 of the sleeve 17, which is rigidly connected to the inertia member 10, and the shoulder 26 on the rod 18, thereby urging the rod 18 and the grip element 12 forwards relative to the inertia member 10.

The springs 15, 16 are pretensioned at the assembly of the tool and act between the grip element 12 and the inertia member 10 in opposite directions. Thereby, a balanced neutral position is obtained between the grip element 12 and the inertia member 10, and as soon as the relative position between these two elements is changed, due to vibration forces, the springs 15, 16 act to regain the neutral position. The springs 15, 16 act continuously without any steps in the generated balancing forces.

By arranging the counteracting damping springs 15, 16 coaxially to cooperate with each other by means of an intermediate support sleeve 17 and a central rod 18, there is obtained a very compact damping system and a very compact tool suitable for use in cramped working areas. The above described damped hand held rivet bucking tool is intended primarily for rivetting in narrow spaces at aircraft assembly.

I claim:

1. A vibration damped hand held rivet bucking tool, comprising:

a vibration exposed inertia member (10) having a rivet engaging implement (11) at a forward end thereof;

a handle means (12); and a vibration damping system interposed between said inertia member (10) and said handle means (12), said inertia member (10) being movable relative to said handle means;

said vibration damping system comprising:

one large diameter coil spring (15);

one small diameter coil spring (16) arranged coaxially with said large diameter coil spring;

a threaded sleeve element (17) located between said coil springs (15,16) and which is removably secured to said inertia member (10);

a rod (18) having two ends, said rod being rigidly secured at one end thereof to said handle means (12), and said rod extending into said small diameter coil spring (16);

said large diameter coil spring (15) being supported between an outer facing shoulder (23) on said sleeve element (17) and said handle means (12); and said small diameter coil spring (16) being supported between an inner facing shoulder (24) on said sleeve element (17) and an outer facing shoulder (26) on said rod (18); and wherein said inertia member (10) is substantially cylindrical in shape and has a substantially central bore (20) for accommodating said coil springs (15,16) and said sleeve element (17) in said bore (20).

2. The vibration damped hand held rivet bucking tool according to claim 1, wherein said handle means (12) comprises a cup-shaped grip element arranged to guidingly receive at least a major part of said inertia member (10).

3. The vibration damped hand held rivet bucking tool according to claim 2, wherein said cup-shaped grip element encloses at least a major part of said inertia member (10).

4. The vibration damped hand held rivet bucking tool according to claim 1, wherein said handle means (12) encloses at least a major part of said inertia member (10).

5. The vibration damped hand held rivet bucking tool according to claim 1, wherein said outer facing shoulder on said rod (18) is at the other of said two ends of said rod (18).

6. The vibration damped hand held rivet bucking tool according to claim 5, wherein at least a portion of said rod (18) is received in said bore (20) of said inertia member.

7. The vibration damped hand held rivet bucking tool according to claim 1, wherein at least a portion of said rod (18) is received in said bore (20) of said inertia member.

* * * * *